United States Patent [19]

Nichols

[11] Patent Number: 5,042,174

[45] Date of Patent: Aug. 27, 1991

[54] NOVEL SHOE SOLE CONSTRUCTION

[75] Inventor: Steven B. Nichols, Brentwood, Calif.

[73] Assignee: K-Swiss Inc., Pacoima, Calif.

[21] Appl. No.: 444,756

[22] Filed: Dec. 1, 1989

[51] Int. Cl.[5] ..... A43B 13/00

[52] U.S. Cl. ..... 36/25 R; 36/30 R; 36/31

[58] Field of Search ..... 36/28, 30 R, 31, 114, 36/107, 108, 76 R

[56] References Cited

U.S. PATENT DOCUMENTS

| | | | |
|---|---|---|---|
| 4,040,192 | 8/1977 | Perez | 36/108 |
| 4,481,726 | 11/1984 | Philips | 36/30 R X |
| 4,506,462 | 3/1985 | Cavanagh | 36/30 R X |
| 4,766,679 | 8/1988 | Bender | 36/30 R |
| 4,854,057 | 8/1989 | Misevich et al. | 36/30 R X |

*Primary Examiner*—Paul T. Sewell
*Assistant Examiner*—BethAnne Cicconi
*Attorney, Agent, or Firm*—Drucker & Sommers

[57] ABSTRACT

A unitary multilayer sole construction for an athletic shoe in which a stiffening board member is provided between the outsole and the mid-sole of the shoe. The stiffening board member is placed in the rear foot portion of the shoe and immediately adjacent the inner surface of the outsole.

10 Claims, 2 Drawing Sheets

NOVEL SHOE SOLE CONSTRUCTION

BACKGROUND OF THE INVENTION

This invention relates to shoe sole construction, especially construction as related to athletic shoes wherein rear foot stability, front foot flexibility, and comfort are prime requisites.

In prior art shoe construction, as exemplified by FIG. 1, it is traditional for rear foot stability (both lateral and medial) to be provided by a substantially rigid sheet of material (4) overlying the relatively soft, thick, resiliently flexible mid-sole (5). In such traditional construction, the rigidity of the rigid sheet (4), while achieving the goal of rear foot stability obscured the desired advantages of the cushioning and is not completely satisfactory.

SUMMARY OF THE INVENTION

This invention relates to a novel sole construction in an athletic shoe wherein the sole construction is multilayered and comprises the following components:

Layer 1: an outsole member usually comprised of one or more types of resilient rubber or plastic; flexible thin, board-like Layer 2: an essentially non-flexible thin, board-like member made of, for example, polypropylene plastic immediately overlying the outsole but only in the rear foot portion of the outsole;

Layer 3: a relatively soft, thick cushioning mid-sole layer of rubber material or plastic materials such as sponge rubber or a polyurethane directly overlying the rear foot portion and the frontal portion of the unexposed (inner) surface of the outsole;

Layer 4: a flexible fabric layer to which the upper of the shoe is sewn (this layer is optional); and Layer 5: a resiliently flexible insole member immediately adjacent either layer 3 or 4.

Layers 1, 2 and 3 (and layer 4, if present) are formed into an integral unit, as by suitable adhesives, under heat and/or pressure. The insole (layer 5) is usually made as a separable unit, for easy removal and replacement, if necessary.

The multilayer construction of this invention provides great rear foot lateral and medial stability while at the same time permitting a flexible, cushioning, for the foot of the wearer-enabling the full effect of the cushioning mid-sole to be felt. In addition, the upper surface of the mid-sole member is sometimes contoured, and the presence of a stiffening board member thereover would defeat the desired effect of the contoured mid-sole.

DETAILED DESCRIPTION OF THE INVENTION

Figure 1:
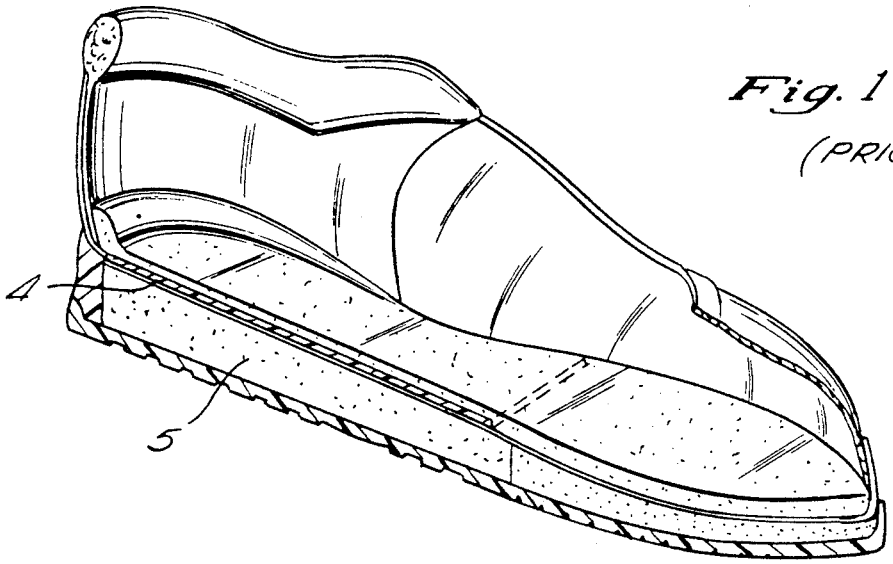
Fig. 1 (PRIOR ART)
FIG. 1 is a medial cross-section in perspective, of an athletic shoe of the prior art.
Figure 2:
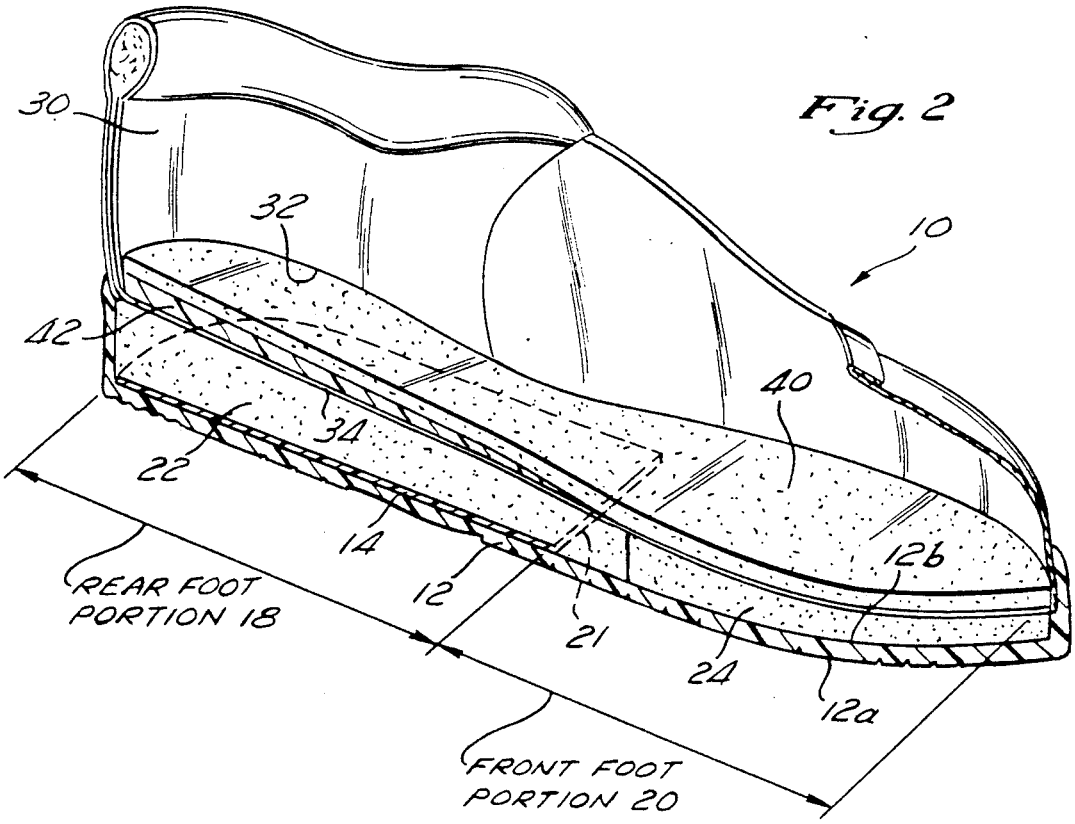
FIG. 2 is a medial cross-section, in perspective, of an athletic shoe having the multilayer sole construction of this invention.
Figure 3:
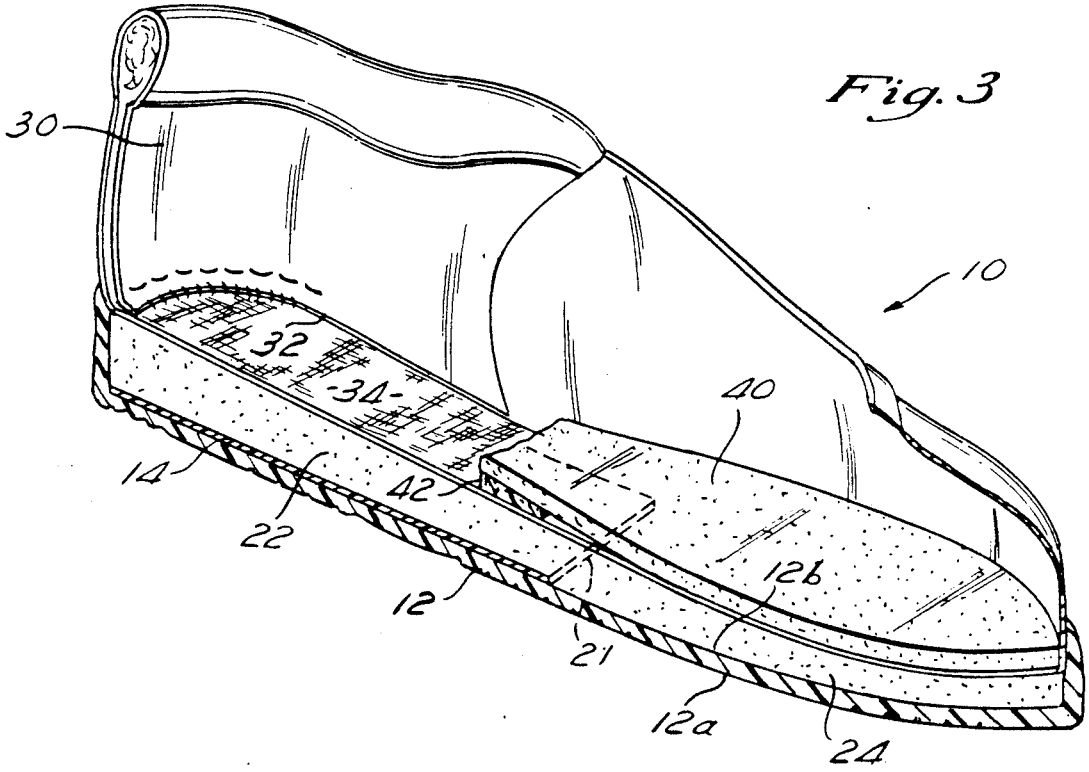
FIG. 3 is a further medial cross-section, in perspective, with the insole partially cut away to reveal the construction of the shoe upper.

The sole construction of this invention is shown in FIGS. 2 and 3, the shoe being designated generally by numeral 10. As can be seen in FIG. 3, the outsole, or first layer lies, generally, in a single plane. Said outsole, or first layer, is designated by the numeral 12 and comprises one or more types of relatively hard, but slightly resilient, rubber or plastic materials. The outsole has an outer surface 12*a* and an inner surface 12*b*, the inner surface being divided into a rear foot portion 18 and a front foot portion 20.

The second layer 114 of material comprises an essentially non-flexible (i.e., substantially rigid) board-like member made, for example, of polypropylene plastic. The layer 14 hereinafter sometimes referred to as the board or shank member directly overlies the rear-foot portion 18 of the outsole. The rear-foot portion 18 commences along a line 21 just behind the ball of the foot and ending at the heel. The front foot portion 20 commences at the front of the shoe and terminates at line 21. Because the board member 14 terminates just behind the ball of the foot, rear foot stability and rigidity which results from the presence of the board member 14 will not affect the desired flexibility in the frontal portion 20 of the foot.

Directly overlying the board member 14 and the frontal foot portion 20 of the inner surface 12*b* of the outsole 12 are mid-sole members 22, 24. Mid-sole members 22, 24 are substantially thicker and softer than the outsole 12, and are resiliently flexible. Rear mid-sole member 22 is preferred to be of a somewhat stiffer durometer rating than the frontal mid-sole member—again to aid in rear foot stability while permitting greater flexibility of the movement in the forefront of the foot.

The shoe upper 30 is molded about the last, in a conventional manner, the bottom edge 32 of the shoe upper being spacedly held or maintained, during the lasting process by flexible cloth-like fabric layer 34, made of cotton or plastic material (see FIG. 3).

The outsole 12, board member 14 and mid-sole members 22, 24 together with the fabric layer 34 of shoe upper 30 are integrated into a single unit, by means of conventional adhesives, and under conventional heat and pressure cycles and operations.

The inner sole member 40, 42 is resiliently flexible, soft, relatively thin compared to the mid-sole, and has its upper surface preferably contoured to the shape of the foot. A single inner sole layer 40 may be used instead of composite inner member 40, 42 shown.

The inner sole member 40, 42 is preferably a member separable from the remainder of the unitary sole construction described herein, so that it may be removed and replaced, if desired.

The advantages of this invention are very substantial. By means of a seemingly simple juxtaposition of elements, one may realize the full advantages to be gained from a cushioned, contoured mid-sole while, at the same time, not forfeiting the great desired rear foot stability, both lateral and medial.

I claim:

1. A multilayer shoe sole construction which comprises, in combination:

as a first layer a resilient outsole lying generally in a single plane, and forming an outer surface and an inner surface, said inner surface having a rear foot portion, extending from behind the ball of the foot of a wearer and ending at the heel of the wearer, and a frontal foot portion;

as a second layer, immediately adjacent to and overlying substantially the entire said rear foot portion of said inner surface of said outsole but not overlying any of said front foot portion, a single, thin, sheet of substantially inflexible, board-like, stiffener material lying parallel to said entire signal planar outsole;

as a third layer, a relatively thick, resiliently flexible cushioning mid-sole member directly overlying both said second layer of material and said frontal foot portion of said first layer; and as a fourth layer, immediately overlying said midsole member, a resiliently flexible inner sole.

2. In a multilayer shoe construction having a relatively hard outer sole consisting of a rear foot portion, extending from behind the ball of the foot of a wearer and ending at the heel of the wearer, and a front foot portion, both said rear foot portion and said front foot portion of said outsole lying generally in a single plane, a resiliently flexible mid-sole and a relatively soft, resiliently flexible inner sole, the improvement which comprises: the addition of a single thin, relatively rigid, non-resilient, sheet of board-like stiffener material held between the outer sole and the mid-sole and overlying substantially the entire rear foot portion of said outer sole but not overlying any of said front foot portion, said sheet of board-like stiffener material lying parallel to both said rear foot portion and said front portion of said entire single planar outsole.

3. The multilayer shoe sole construction of claim 1 wherein the first, second and third layers are integrated into one unit.

4. The multilayer shoe of claim 1 wherein the first layer is made of material selected from rubber of plastic materials.

5. The multilayer shoe sole construction of claim 1 wherein the third layer provides a cushioning effect to the wearer of the shoe.

6. The multilayer shoe sole construction of claim 1 wherein the first, second and third layers are integrated into a single unit, and said fourth layer is separable from said integrated first, second and third layers.

7. The multilayer shoe sole construction of claim 1 wherein a fifth flexible fabric layer is interposed between said third and fourth layers, said flexible fabric layer being affixed to a shoe upper.

8. The multilayer shoe sole construction of claim 2 wherein said mid-sole provides a cushioning effect to the wearer of the shoe.

9. The multilayer shoe sole construction of claim 2 wherein said outsole, said rigid, non-resilient sheet of board-like material, and said mid-sole are integrated into a single unit, and said inner sole is separable from said single unit.

10. The multilayer shoe sole construction of claim 2 wherein a fifth flexible fabric layer is interposed between said mid-sole and said inner sole, said flexible fabric layer being affixed to a shoe upper.

* * * * *